US008096904B2

(12) United States Patent
Esser

(10) Patent No.: US 8,096,904 B2
(45) Date of Patent: Jan. 17, 2012

(54) PRINTED NET

(76) Inventor: Ralf Esser, Hennef (DE)

( * ) Notice: Subject to any disclaimer, the term of this patent is extended or adjusted under 35 U.S.C. 154(b) by 0 days.

(21) Appl. No.: 10/578,759

(22) PCT Filed: Nov. 6, 2004

(86) PCT No.: PCT/DE2004/002468
§ 371 (c)(1),
(2), (4) Date: May 5, 2006

(87) PCT Pub. No.: WO2005/044398
PCT Pub. Date: May 19, 2005

(65) Prior Publication Data

US 2007/0082763 A1 Apr. 12, 2007

(30) Foreign Application Priority Data

Nov. 7, 2003 (DE) ..... 103 52 531

(51) Int. Cl.
*A63B 69/00* (2006.01)
*A63B 61/00* (2006.01)

(52) U.S. Cl. ..... 473/494

(58) Field of Classification Search ..... 473/459, 473/490, 491, 494, 496; 40/603; 404/6
See application file for complete search history.

(56) References Cited

U.S. PATENT DOCUMENTS 4,073,491 A * 2/1978 Sepaniac ..... 473/494
4,932,705 A * 6/1990 Miller ..... 296/50
5,052,686 A * 10/1991 Pryor ..... 473/494
5,182,889 A * 2/1993 Johnson ..... 52/298
5,601,907 A * 2/1997 Matsumoto ..... 442/1
5,630,589 A 5/1997 Adie et al.
6,004,649 A 12/1999 Nagata
6,250,634 B1 6/2001 Strain et al.
2002/0092218 A1 * 7/2002 Black ..... 40/603
2006/0105865 A1 * 5/2006 Bourdages ..... 473/476
2007/0049430 A1 * 3/2007 Hatfalvi ..... 473/496
2007/0082763 A1 * 4/2007 Esser ..... 473/459

FOREIGN PATENT DOCUMENTS

DE 2619512 A1 11/1976
DE 4209105 A1 9/1993
EP 1241654 A1 9/2002
GB 1535260 A 12/1978

OTHER PUBLICATIONS

International Search Report and International Preliminary Report on Patentability issued in related International Application No. PCT/DE2004/002468.

* cited by examiner

*Primary Examiner* — Raleigh W. Chiu
(74) *Attorney, Agent, or Firm* — Connolly Bove Lodge & Hutz LLP

(57) ABSTRACT

The invention relates to a novel net, in particular for sports, such as a volleyball net, tennis net or goal net, which can be provided with advertising or other information. Said net is characterized by a mesh structure that is formed by a film containing holes distributed over its surface. A film of this type can be printed before the holes are produced, thus enabling advertising or other information to be applied by simple printing presses.

28 Claims, 3 Drawing Sheets

PRINTED NET

The invention relates to a net, in particular a sports net, such as a volleyball net, tennis net, goal net or protective sports net, and a method for its manufacture.

Nowadays sports events are being used with increasing frequency and intensity for advertising purposes. Here advertising spaces that are in the field of vision of the spectators play an important role because it is not only the spectators in a sports arena at whom the advertising may be directed, but also a much wider public, in the form of television transmissions or television recordings, particularly in the case of top class sports events. Use is made not only of strips on the edge of playing grounds, for example soccer fields, as advertising spaces, but in many cases also of large area nets such as those used, for example, in types of sport such as volleyball, tennis or soccer. Thus in various tennis tournaments the tennis nets are provided with advertising texts in the vicinity of the posts. For this purpose the nets, which normally consist of textile threads that are tied together to form meshes, are applied with a template and sprayed with paint.

Such a process suffers from a great many disadvantages. If the text is to combine several colours, a new template must be applied for each colour so that the painting process has to be repeated, which is comparatively expensive. Moreover, most of the spray paint is lost because it is sprayed through the meshes.

Against this background the object of the invention is to provide a net and a method for its manufacture in which simple application of the advertising or other information is possible.

This object is achieved with a net having the characteristics of claim 1 and a method for its manufacture with the characteristics of claim 15.

An essential concept of the invention consists in the fact that the net material is no longer made of string or threads tied together to form meshes, but of a flat foil, in particular a holohedric foil, from which holes are taken out, so that a mesh structure of a large number of bridges connected together remains.

Whilst it was not possible in to colour conventional nets essentially in a cost-effective way before the meshes are tied, and the application of advertising is expensive after tying, it is possible, in the nets according to the invention, to feed the foil to a printing machine, for example, and to print it on one or both sides fully or partially. This preferably takes place before holes are made in the foil, i.e. before the foil receives its mesh structure, but may, depending on the strength of the foil, also take place after the holes have been made. Thus, it is possible to easily provide the nets according to the invention partially or on the whole surface with information or advertisings.

Another possibility of providing advertising is to coat the foil with an adhesive film bearing the information, before the holes are inserted into the combination of foil and adhesive film.

Another particular advantage of the invention lies in the fact that the thickness of the foil and hence the thickness of the remaining bridges are less, if the foil material is sufficiently strong, than the thickness of that for conventional nets of textile threads or string, so that the opening of the meshes, to an observer standing at an acute angle to the net, is larger than in conventional nets. This is particularly advantageous in the case of volleyball and beach volleyball nets, since in these types of sports in particular it is important to be able to observe the other side of the playing field or court at an acute angle through the net.

In principle the holes may have any shape. On the basis of conventional nets a square hole shape is suitable, wherein the corners of the holes can be rounded to improve the flow of forces through the mesh bridges and increase the tearing strength.

The area ratio of the holes to the mesh foil is preferably 3:1 or more, and in particular preference 4:1 or more. Essential criteria on the basis of which the area ratio can be established are, in particular, the transparency of the net required for the area of use, the forces acting on the net and to be absorbed by it, and the surface area required for optimum representation of the information.

In the case of square or rectangular holes in particular, it may be advantageous for the bridges of the mesh foil running between the holes, particularly the bridges running in the horizontal and vertical direction, to be of different widths. For example, bridges running horizontally in the case of tensile forces to be absorbed essentially in the transverse direction can be constructed wider than the bridges running vertically, wherein the vertically running bridges have essentially the task of maintaining the horizontal bridges at a uniform distance from each other.

Apart from the idea of nets with square or rectangular meshes, the size, shape and/or arrangement of the holes relative to each other are preferably adapted to the text, or for an optimised flow of forces within the net structure, and if necessary vary throughout the surface of the net.

In principle it is possible to clamp nets between posts or in a frame structure by means of clips engaging on their lateral edges. It is preferable, however, to provide fixing means, lugs for example, on the nets according to the invention by means of which the nets can be clamped. Thus at least one loop running at least partially along one of the lateral edges of the foil is provided in a preferred embodiment, through which loop the strings may be passed for fastening and clamping purposes. A plurality of loops arranged adjacent to each other may also preferably be arranged on one or more sides of the foil. Moreover, a loop extending along at least 90% of the length of one lateral edge may also be preferable, depending on the nature and function of the net. The loops may, for example, be produced by folding the lateral regions of the foil, in which case the free edges of the foil section folded over can be welded, glued or, if necessary, even sewn to the remainder of the foil.

If individual loops are required on one side of the foil, surpluses areas can be cut away in the lateral regions of the foil, preferably before the lateral regions are folded over.

Another form of fixing means are lugs which, alternatively or supplementary to the loops, can be arranged in one or more edge regions of the foil, particularly in their corners.

The foils may preferably be plastic foils, in particular plastic foils containing polyethylene, polypropylene, polyamide and/or PVC. Moreover, foils with a textile structure whose fibres are glued or welded together, have proved advantageous.

Finally, it may also be an advantage for the foil material used to be transparent or semi-transparent, depending on the application.

As already mentioned it is advantageous, when manufacturing a net according to the invention, for the foil to be printed on one or both sides before the holes are made in the foil. Simple possibilities of making the holes in the foil consist in punching out, welding out, cutting or engraving the holes. Here the holes can be cut or engraved with conventional cutters, but can also be cut with a water jet under high pressure, if necessary also by means of a laser cutting method. In the latter case care must be taken, if necessary, to ensure that the strength and/or elasticity properties of the foil on the cutting edge do not deteriorate or do not deteriorate significantly due to the thermal conditions.

It is appropriate, particularly in cutting processes in which the cutting pattern can be electronically controlled or regulated, to adapt the shape, size and arrangement of the holes in the foil to a particular text. In most types of sports a regular, symmetrical arrangement and shape of the holes is not absolutely necessary, thus providing the possibility of highlighting more clearly the information applied to a foil by suitable arrangement and shaping of the holes by arranging holes along a text edge, for example, instead of allowing them to overlap a cutting edge, thereby disturbing the contour of the text. Correspondingly the shape, size and arrangement of the holes in the foil may also be adapted to the expected flow of forces within the net and may vary, if necessary, throughout the area of the net.

In order to provide a loop on the foil by simple means, to interact with the pull string for securing the net, for example, at least one partial section of one side of the foil may be folded over and the associated lateral edge secured, and in particular welded, to the foil. Other preferred possibilities of securing the lateral edge consist in sewing or gluing it to the foil.

One or more lateral edges may similarly be reinforced by folding, coiling and gluing, sewing or welding. It is also possible to reinforce the lateral edges by thermal shaping. It may also be advantageous here for a string, particularly a pull string, to be wound or folded into the lateral edge as this will avoid having to pull the string tediously through a loop provided for this purpose, and ensures that the string is connected more securely to the net edge.

The invention is explained in greater detail in the following with reference to figures which show, as examples, the intermediate products in the production of a simple embodiment of a net according to the invention.

Figure 3:
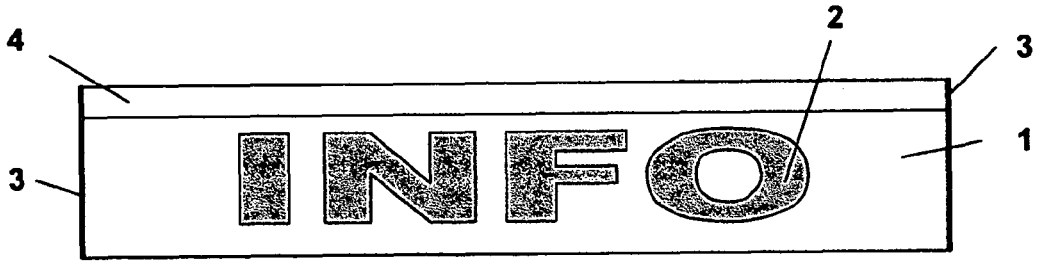
Figure 4:
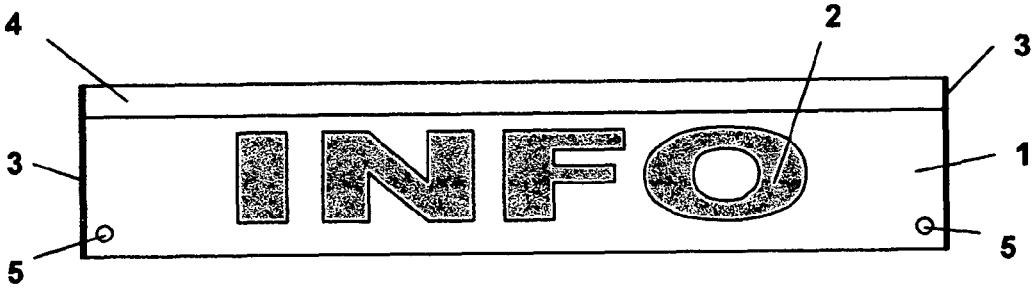
Figure 5:
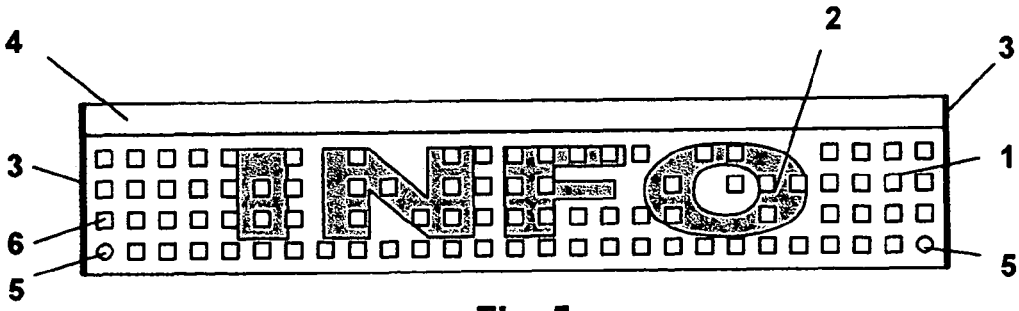
Figure 3A:
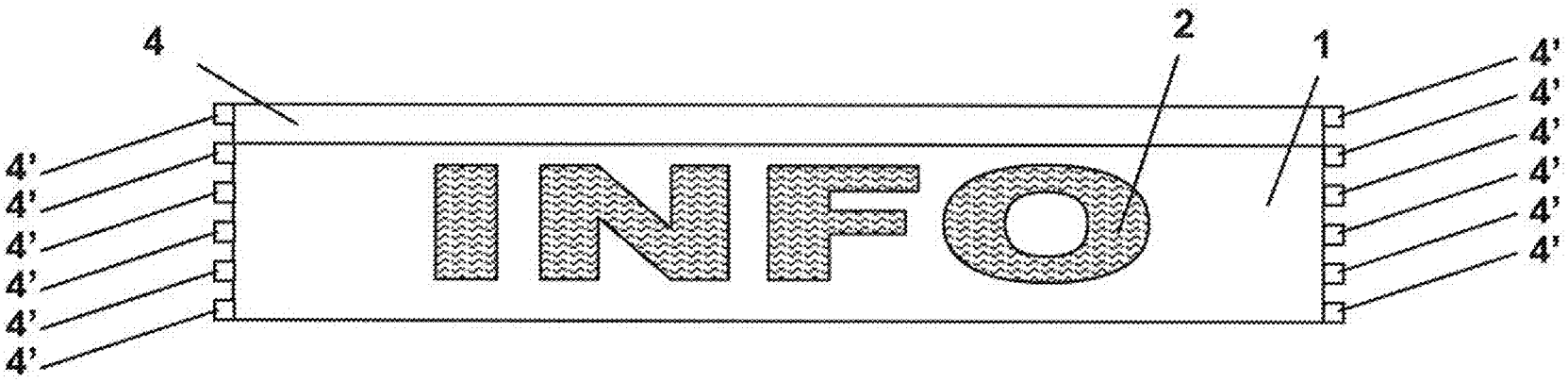
Figure 6:
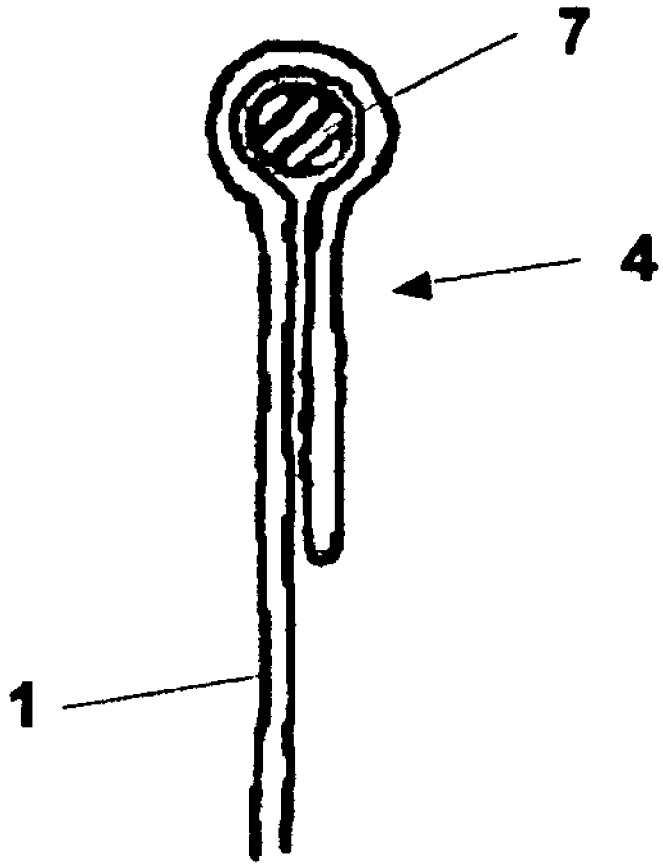

FIGS. 3, 3*a* show a foil with an upper side folded over to form a longitudinal loop, FIG. 4 shows the foil according to FIG. 3 with reinforced lugs in its corner regions, FIG. 5 shows the foil according to FIG. 4 with a mesh structure, and FIG. 6 shows a transverse section of part of the foil according to FIG. 5.

Figure 1:
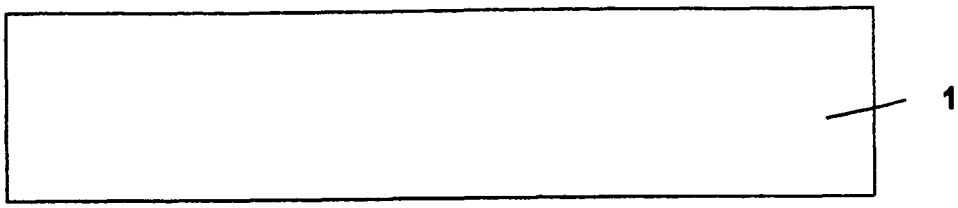
FIG. 1 shows an unprinted foil.
Figure 2:
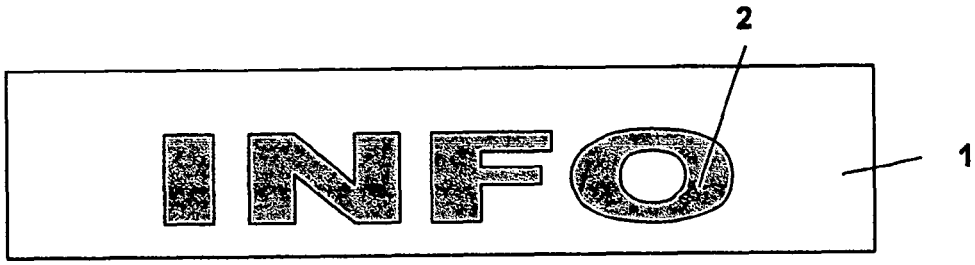
FIG. 2 shows a printed foil.

FIGS. 1 to 5 show the individual stages of manufacture of a net according to the invention. A foil 1 is initially made available in the dimensions required for the net (FIG. 1) and printed with information 2, over all or part of the surface (FIG. 2). After foil 1 has been printed its lateral edges may, if necessary, be folded over or coiled, to reinforce lateral edges 3, for example, but also to provide loops 4, 4' through which strings can be pulled, for example, to secure the net (FIGS. 3, 3*a*). Lugs 5 may also be installed, particularly in reinforced regions of the foil, through which strings can also be pulled to clamp the net (FIG. 4).

Finally, the net is provided with holes 6, for example by mechanical punching, cutting or thermal welding. Not until this is carried out is the net given its mesh structure (FIG. 5). A typical mesh structure has meshes with lateral edges 50 mm long and holes with a lateral length of 45 mm, the bridges therefore being 5 mm in width. As can be seen in the embodiment shown in FIG. 5, the holes are arranged so that they do not engage in the imprint. Moreover, no mesh holes 6 are provided in the corners of the net, in which lugs are provided, so that foil 1 is not weakened by mesh holes in this region.

FIG. 6 shows the upper section of the net shown in FIGS. 3 to 5 in cross-section with the upper lateral edge of foil 1, through which a string 7 is guided, folded over to form a loop 4.

Although the sequence of processing stages indicated is preferred, any other sequence is also possible as long as the holes are made in the foil after the printing process. However, printing is possible even after the holes are made in the foil, provided that the remaining mesh structure is sufficiently rigid to allow the net to retain its shape when printing.

As can easily be seen, this procedure is much less expensive than the tying of threads or strings to form meshes. Thus the particular advantage here lies not only in the possibility of simple printing, but a new type of net shape has been created which even when unprinted has quite considerable advantages over conventional nets.

The invention claimed is:

1. A sports net, including a mesh structure formed by a foil with permanently-open holes distributed over its surface, wherein the sports net is adapted to be used in the playing of at least one sport, and wherein the size, shape and/or arrangement of the holes relative to each other is/are adapted to an imprint and/or for an optimized flow of forces within the net structure, and wherein the size, shape and/or arrangement of the holes relative to each other varies/vary over the surface of the net, according to need.

2. The sports net according to claim 1, wherein the foil is provided with information that is printed partially or fully on one side or on both sides.

3. The sports net according to claim 1 or 2, wherein the holes are essentially square holes.

4. The sports net according to claim 1, wherein the holes are essentially square holes, and wherein the square holes have rounded corners.

5. The sports net according to claim 1, wherein bridges of the foil running between the holes have different widths.

6. The sports net according to claim 1, wherein an area ratio of holes to foil is 3:1 or more.

7. The sports net according to claim 6, wherein the area ratio of holes to foil is 4:1 or more.

8. The sports net according to claim 1, further including fixing means.

9. The sports net according to claim 8, further including at least one loop running at least partially along one of the lateral edges of the foil.

10. The sports net according to claim 8 or 9, further including a plurality of loops arranged adjacent to each other on one or more sides of the foil.

11. A sports net, including a mesh structure formed by a foil with permanently-open holes distributed over its surface, the net having an area ratio of holes to foil of 3:1 or more, wherein the sports net is adapted to be used in the playing of at least one sport, further including fixing means and at least one loop running at least partially along one of the lateral edges of the foil, wherein the at least one loop comprises at least one partial section of one side of the foil that is folded over, and an associated lateral edge of which is secured to the foil.

12. The sports net according to claim 8, further including a loop extending along at least 90% of the length of one lateral edge.

13. The sports net according to claim 8, further including one or more lugs in one or more edge regions of the foil.

14. The sports net according to claim 1, wherein the foil is a plastic foil.

15. The sports net according to claim 1, wherein the foil has a textile structure whose fibers are glued or welded together.

16. The sports net according to claim 1, wherein the foil material is transparent or semi-transparent.

17. The sports net according to claim 1, adapted to be usable as a volleyball net.

18. The sports net according to claim 1, adapted to be usable as a goal net.

19. The sports net according to claim 1, adapted to be usable as a tennis net.

20. The sports net according to claim 1, adapted to be usable as a protective sports net.

21. A method for manufacturing a sports net, wherein a foil is made available in which permanently-open holes are made so that a net or mesh structure is formed; wherein the foil is printed on one or both sides before the holes are made; and wherein the resulting foil is made into a sports net adapted to be used in playing at least one sport.

22. The method according to claim 21, wherein the holes are punched out, welded out, cut or engraved.

23. The method according to claim 21, wherein the shape, size and arrangement of the holes are adapted to an imprint.

24. The method according to claim 21, wherein at least one characteristic selected from the group consisting of the shape, size and arrangement of the holes in the foil is adapted to the flow of forces inside the net and varies throughout the surface of the net.

25. The method according to claim 21, wherein at least one partial section of one side of the foil is folded over and the associated lateral edge is secured to the foil.

26. The method according to claim 25, wherein the lateral edge of the side folded over or the lateral section folded over is welded to the foil.

27. The method according to claim 21, wherein one lateral edge is folded, coiled, glued or welded to reinforce said lateral edge.

28. The method according to claim 27, further including folding or wrapping a string.

* * * * *